US007716944B2

(12) United States Patent
Murai

(10) Patent No.: US 7,716,944 B2
(45) Date of Patent: May 18, 2010

(54) INDOOR UNIT OF AIR CONDITIONER

(75) Inventor: Yuuichi Murai, Kusatsu (JP)

(73) Assignee: Daikin Industries, Ltd., Osaka (JP)

( * ) Notice: Subject to any disclaimer, the term of this patent is extended or adjusted under 35 U.S.C. 154(b) by 616 days.

(21) Appl. No.: 10/594,712

(22) PCT Filed: Apr. 8, 2005

(86) PCT No.: PCT/JP2005/006915

§ 371 (c)(1),
(2), (4) Date: Sep. 28, 2006

(87) PCT Pub. No.: WO2005/098319

PCT Pub. Date: Oct. 20, 2005

(65) Prior Publication Data

US 2008/0250808 A1 Oct. 16, 2008

(30) Foreign Application Priority Data

Apr. 8, 2004 (JP) ..... 2004-113982

(51) Int. Cl.
*F25D 17/06* (2006.01)

(52) U.S. Cl. ..... 62/419; 62/262; 62/411

(58) Field of Classification Search ..... 62/419, 62/262, 259.1, 411, 298
See application file for complete search history.

(56) References Cited

U.S. PATENT DOCUMENTS

| | | | | |
|---|---|---|---|---|
| 5,222,373 | A | 6/1993 | Waldschmidt | |
| 5,878,591 | A * | 3/1999 | Tsuji et al. | 62/285 |
| 6,357,247 | B1 | 3/2002 | Moretti | |

FOREIGN PATENT DOCUMENTS

| | | | |
|---|---|---|---|
| JP | 63-104940 | U | 7/1988 |
| JP | 04-20923 | U | 2/1992 |
| JP | 04-22205 | U | 5/1992 |
| JP | 07-12853 | U | 3/1995 |
| JP | 07-98129 | | 4/1995 |
| JP | 2000-234760 | A | 8/2000 |
| JP | 2002-295888 | A | 10/2002 |
| JP | 2003-130382 | A | 5/2003 |
| JP | 2005-036998 | A | 2/2005 |
| JP | 2005-147618 | A | 6/2005 |
| RU | 2185574 | | 7/2002 |
| SU | 964365 | | 10/1982 |

* cited by examiner

*Primary Examiner*—Melvin Jones
(74) *Attorney, Agent, or Firm*—Global IP Counselors

(57) ABSTRACT

An indoor unit of an air conditioner includes an indoor unit casing, a horizontal flap, and a front panel. The indoor unit casing includes an outlet through which air is blown into a room. The horizontal flap is disposed so as to freely open and close the outlet and guides the air blown out through the outlet. In a closed state, the front panel covers at least part of the indoor unit casing and at least one end of the horizontal flap closing the outlet.

10 Claims, 7 Drawing Sheets

INDOOR UNIT OF AIR CONDITIONER

CROSS-REFERENCE TO RELATED APPLICATIONS

This U.S. National stage application claims priority under 35 U.S.C. §119(a) to Japanese Patent Application No. 2004-113982, filed in Japan on Apr. 8, 2004, the entire contents of which are hereby incorporated herein by reference.

TECHNICAL FIELD

The present invention relates to an indoor unit of an air conditioner.

BACKGROUND ART

An indoor unit of an air conditioner is often disposed with a casing, which includes an outlet through which air is blown into a room, and a flap, which guides the air blown through the outlet. The flap is disposed so as to freely open and close the outlet, and is disposed so as to close the outlet in a closed state (Japanese Patent Publication No. 2003-130382, FIG. 1).

However, in the state where the flap closes the outlet, a borderline arises between the flap and the outlet. Conventionally, this borderline appears in the exterior of the indoor unit of the air conditioner and can easily be seen by the eyes of residents and the like in the room. For this reason, the borderline becomes design noise and results in marring the aesthetic look, such as lowering the interiority, of the indoor unit of the air conditioner.

SUMMARY OF THE INVENTION

It is an object of the present invention to provide an indoor unit of an air conditioner whose aesthetic look can be improved.

An indoor unit of an air conditioner pertaining to a first aspect of this invention is disposed with a casing, a flap, and a front panel. The casing includes an outlet through which air is blown into a room. The flap is disposed so as to freely open and close the outlet and guides the air blown out through the outlet. In a closed state, the front panel covers at least part of the casing and at least one end of the flap closing the outlet.

In this indoor unit of an air conditioner, the front panel covers at least part of the casing and at least one end of the flap closing the outlet, so that the borderline between the flap and the outlet can be hidden and made difficult to see from the outside. For this reason, in this indoor unit of an air conditioner, cases where the aesthetic look is marred by the borderline can be controlled, and the aesthetic look can be improved.

An indoor unit of an air conditioner pertaining to a second aspect of this invention is the indoor unit of an air conditioner of the first aspect of this invention, wherein the flap has a long and narrow shape. Additionally, the front panel covers at least one end that forms a long side of the flap.

In this indoor unit of an air conditioner, because the front panel covers at least one end that forms a long side of the flap, the front panel can hide the borderline between the outlet and the one end that forms a long side of the flap, which is apparently easily seen. Thus, in this indoor unit of an air conditioner, the aesthetic look can be further improved.

An indoor unit of an air conditioner pertaining to a third aspect of this invention is the indoor unit of an air conditioner of the first aspect of this invention or the second aspect of this invention, wherein a gap is disposed between the casing and the flap closing the outlet. Additionally, the front panel covers the gap in the closed state.

When the outlet is opened and closed by the flap, sometimes a gap is disposed between the flap and the casing.

In this indoor unit of an air conditioner, because the front panel covers this gap in the closed state, the gap which has great potential to mar the aesthetic look can be hidden.

An indoor unit of an air conditioner pertaining to a fourth aspect of this invention is the indoor unit of an air conditioner of any of the first aspect of this invention to the third aspect of this invention, wherein the outlet is disposed in a lower portion of the casing. Additionally, the front panel overlaps at least an upper end of the flap in the closed state.

In this indoor unit of an air conditioner, the front panel overlaps at least an upper end of the flap in the closed state. For this reason, the gap between the upper end of the flap and the casing is hidden by the front panel. Thus, in this indoor unit of an air conditioner, cases where the aesthetic look is marred by the gap between the upper end of the flap and the casing can be controlled, and the aesthetic look can be further improved.

An indoor unit of an air conditioner pertaining to a fifth aspect of this invention is the indoor unit of an air conditioner of any of the first aspect of this invention to the fourth aspect of this invention, wherein in the closed state, the front panel covers at least one end of the flap and an inlet through which air is taken into the casing.

In this indoor unit of an air conditioner, in the closed state, the front panel closes not only one end of the flap but also the inlet. For this reason, in the closed state, the inlet can also be hidden. Thus, in this indoor unit of an air conditioner, the aesthetic look can be further improved.

An indoor unit of an air conditioner pertaining to a sixth aspect of this invention is the indoor unit of an air conditioner of the fifth aspect of this invention, wherein the front panel includes a first panel portion that covers at least one end of the flap and a second panel portion that covers the inlet. Further, the first panel portion and the second panel portion are integrated.

In this indoor unit of an air conditioner, the inlet and at least one end of the flap can be covered by the front panel in which the first panel portion and the second panel portion are integrated. Consequently, the parts configuration can be simplified in comparison to when the first panel portion and the second panel portion are configured separately.

An indoor unit of an air conditioner pertaining to a seventh aspect of this invention is the indoor unit of an air conditioner of the sixth aspect of this invention, wherein the casing includes a first casing surface and a second casing surface. The outlet is disposed in the first casing surface. The inlet is disposed in the second casing surface, and the second casing surface forms a predetermined angle with respect to the first casing surface. Additionally, the first panel portion and the second panel portion are integrated at the predetermined angle so as to follow the first casing surface and the second casing surface in the closed state.

In this indoor unit of an air conditioner, the first panel portion and the second panel portion are integrated at the predetermined angle so as to follow the first casing surface and the second casing surface in the closed state. For this reason, the front panel has a shape along the first casing surface and the second casing surface, and can close both the inlet and at least one end of the flap.

An indoor unit of an air conditioner pertaining to an eighth aspect of this invention is the indoor unit of an air conditioner of the seventh aspect of this invention, wherein the front panel opens the outlet and the inlet as a result of the first panel portion moving along the first casing surface and the second panel portion moving away from the second casing surface.

In this indoor unit of an air conditioner, the front panel opens the outlet and the inlet as a result of the first panel portion moving along the first casing surface and the second panel portion moving away from the second casing surface. When the first panel portion and the second panel portion are configured separately, it is easy for the operation of opening and closing the outlet and the inlet to become complicated, but in this indoor unit of an air conditioner, the integrated front panel moves as described above such that it can easily open the outlet and the inlet. Thus, in this indoor unit of an air conditioner, the outlet and the inlet can be opened by the simple operation of the front panel.

An indoor unit of an air conditioner pertaining to a ninth aspect of this invention is the indoor unit of an air conditioner of the eighth aspect of this invention, wherein the first panel portion blocks the space between the second panel portion and the second casing surface in an open state where the front panel opens the outlet and the inlet.

In this indoor unit of an air conditioner, the first panel portion can block the space between the second panel portion and the second casing in the open state. Thus, in this indoor unit of an air conditioner, the air blown out through the outlet can be prevented from passing between the second panel portion and the second casing and being taken in through the inlet.

An indoor unit of an air conditioner pertaining to a tenth aspect of this invention is the indoor unit of an air conditioner of any of the first aspect of this invention to the ninth aspect of this invention, wherein the outlet has a shape that is long and narrow in a width direction of the casing. Additionally, the front panel has a shape that is longer than the outlet in the width direction.

In this indoor unit of an air conditioner, the front panel has a shape that is longer than the outlet in the width direction. For this reason, the borderline between the flap and the outlet can be hidden by the front panel across a wider range. Thus, in this indoor unit of an air conditioner, the aesthetic look can be further improved.

An indoor unit of an air conditioner pertaining to an eleventh aspect of this invention is the indoor unit of an air conditioner of the tenth aspect of this invention, wherein the front panel has a width that is substantially the same as the width of the casing.

In this indoor unit of an air conditioner, the front panel has a width that is substantially the same as the width of the casing. For this reason, factors having the potential to inhibit the aesthetic look appearing in the surface of the casing can be hidden across a wider range. Thus, in this indoor unit of an air conditioner, the aesthetic look can be further improved.

An indoor unit of an air conditioner pertaining to a twelfth aspect of this invention is the indoor unit of an air conditioner of any of the first aspect of this invention to the eleventh aspect of this invention, wherein the front panel does not include a seam extending in a vertical direction when seen in front view.

In this indoor unit of an air conditioner, the front panel does not include a seam extending in a vertical direction when seen in front view. Consequently, in this indoor unit of an air conditioner, factors having the potential to apparently inhibit the aesthetic look become fewer. Thus, in this indoor unit of an air conditioner, the aesthetic look can be further improved.

An indoor unit of an air conditioner pertaining to a thirteenth aspect of this invention is the indoor unit of an air conditioner of any of the first aspect of this invention to the twelfth aspect of this invention, wherein the front panel covers the entire flap.

An indoor unit of an air conditioner pertaining to a fourteenth aspect of this invention is disposed with a casing, a flap, and a front panel. The casing includes an outlet through which air is blown into a room. The flap is disposed so as to freely open and close the outlet and guides the air blown out through the outlet. In a closed state, the front panel covers the space between the casing and the flap closing the outlet.

An indoor unit of an air conditioner pertaining to a fifteenth aspect of this invention is the indoor unit of an air conditioner of the fourteenth aspect of this invention, wherein the flap covers a lower portion of the outlet in a closed state. Additionally, the front panel covers an upper portion of the outlet in a closed state.

An indoor unit of an air conditioner pertaining to a sixteenth aspect of this invention is the indoor unit of an air conditioner of the fourteenth aspect of this invention or the fifteenth aspect of this invention, wherein the front panel in a closed state covers one end of the flap when seen in front view.

DETAILED DESCRIPTION OF THE INVENTION

<Configuration>

Figure 1:
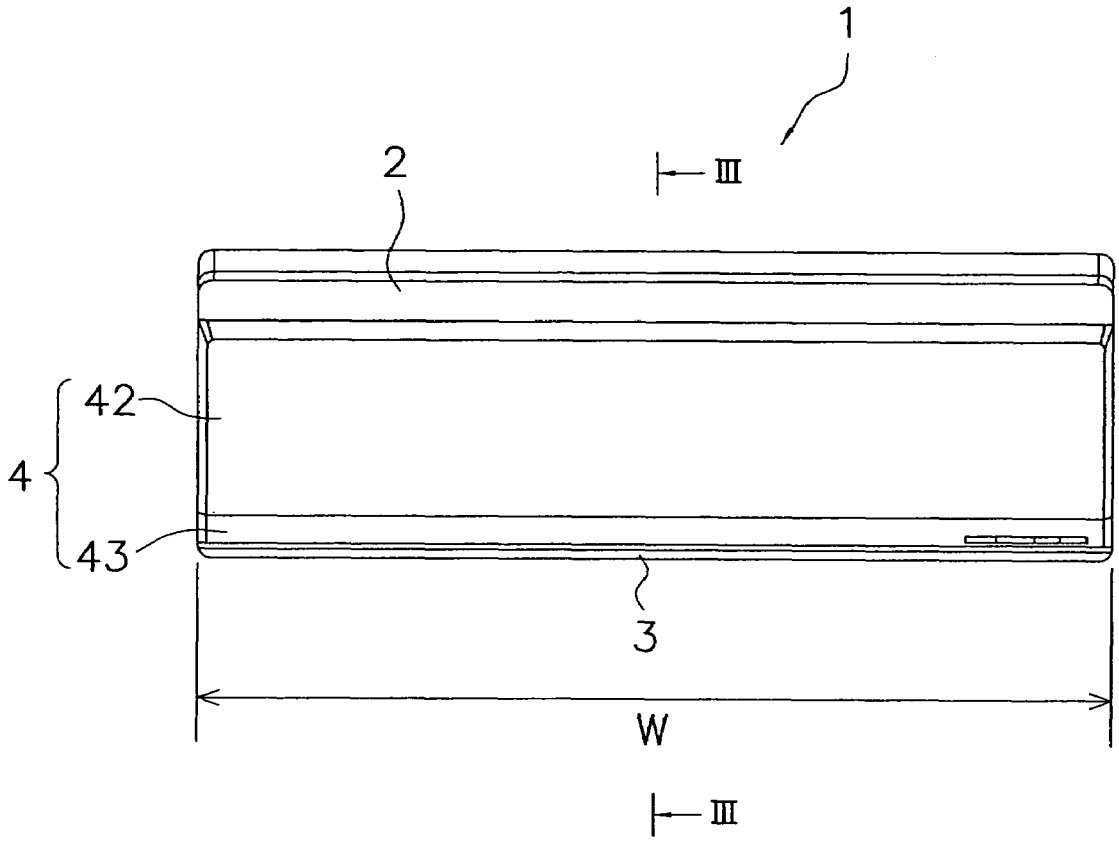
FIG. 1 is a front view of an indoor unit of an air conditioner.
Figure 2:
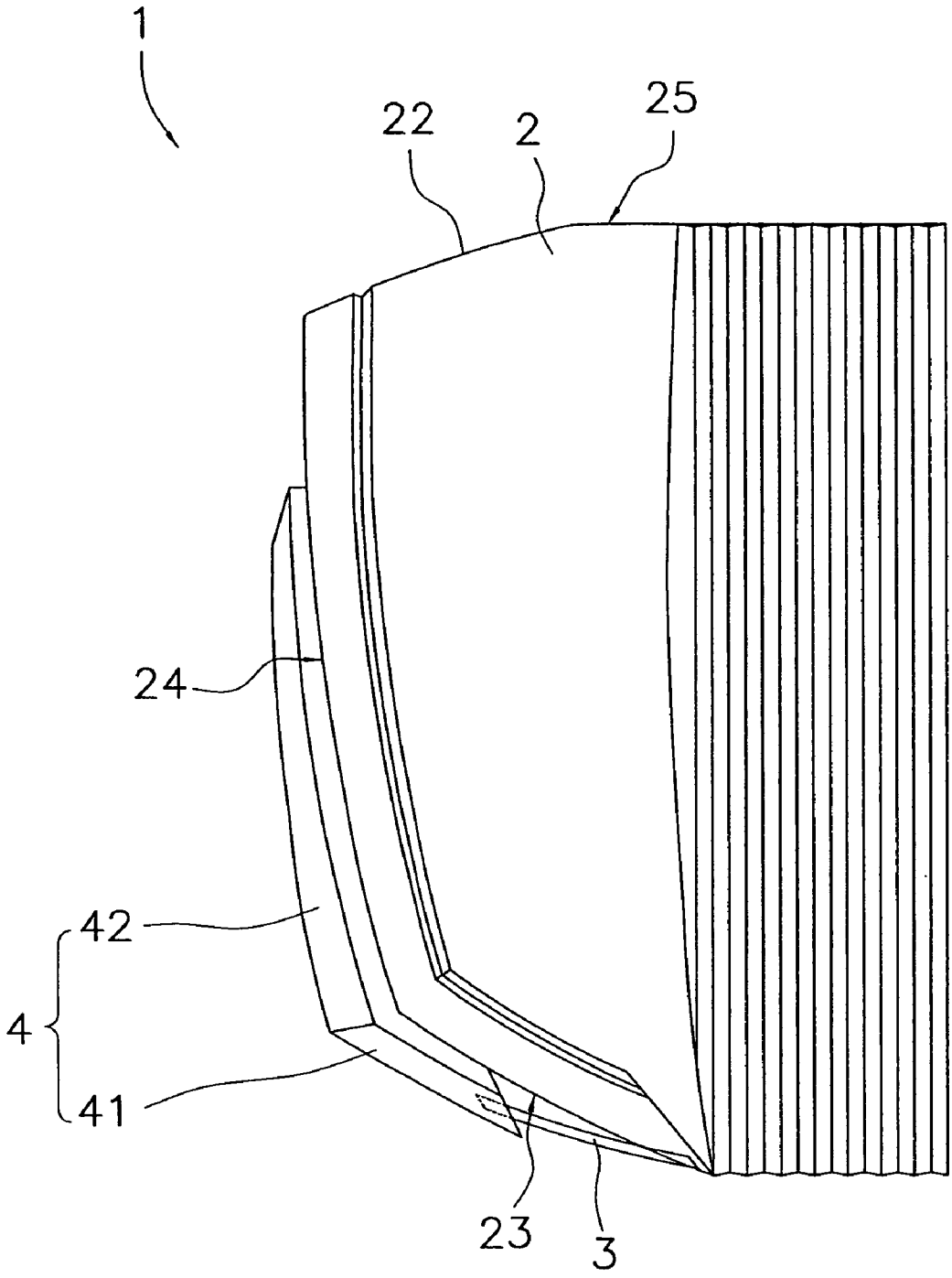
FIG. 2 is a side view of the indoor unit of the air conditioner.

An indoor unit 1 of an air conditioner pertaining to an embodiment of the present invention is shown in FIG. 1 and FIG. 2. FIG. 1 is a front view of the indoor unit 1 of the air conditioner, and FIG. 2 is a side view of the indoor unit 1 of the air conditioner. The indoor unit 1 of the air conditioner is a wall-mounted type of indoor unit that is attached to a wall surface in a room, and performs air conditioning such as cooling and heating the room interior. The indoor unit 1 of the air conditioner is disposed with an indoor unit casing 2 (casing), a horizontal flap 3 (flap), and a front panel 4.

<Indoor Unit Casing>

Figure 3:
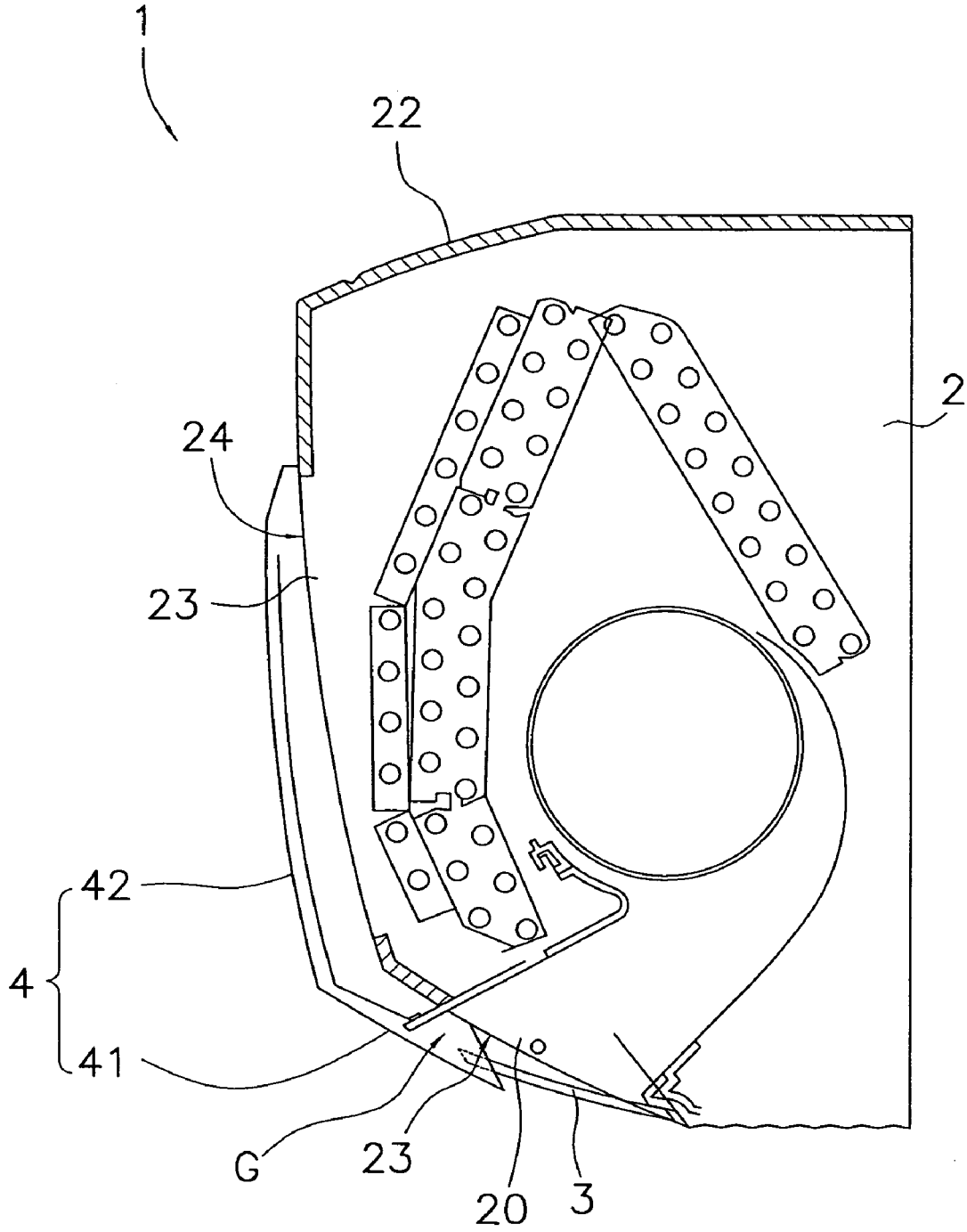
FIG. 3 is a side sectional view of the indoor unit of the air conditioner.

As shown in FIG. 1, the indoor unit casing 2 has a rectangular shape that is long in the horizontal direction when seen in front view, and houses an unillustrated indoor heat exchanger, an indoor fan, and control parts and the like. The front panel 4 is attached to the front of the indoor unit casing 2. The front panel 4 will be described in detail later. As shown in FIG. 3, an outlet 20, a first inlet 21 (inlet), and a second inlet 22 are disposed in the indoor unit casing 2. It will be noted that FIG. 3 is a side sectional view of the indoor unit 1.

The outlet 20 is an opening through which air is blown into the room, and is disposed in a first casing surface 23. As shown in FIG. 2, the first casing surface 23 configures a front side portion of a bottom surface of the indoor unit casing 2, and the outlet 20 is disposed in a lower portion of the indoor unit casing 2. The first casing surface 23 slants such that its front end is positioned above. The outlet 20 has a shape that is long and narrow in a width W direction of the indoor unit casing 2 (the longitudinal direction of the indoor unit casing 2; see FIG. 1), and the horizontal flap 3 is disposed.

The first inlet 21 shown in FIG. 3 is an opening through which air is taken into the indoor unit casing 2, and is disposed in a second casing surface 24. As shown in FIG. 2, the second casing surface 24 configures the front of the indoor unit casing 2, and the first inlet 21 is disposed in the front of the indoor unit casing 2. The second casing surface 24 has a substantially flat shape that extend in the vertical direction, but slants slightly such that its upper end is positioned in front. The lower end of the second casing surface 24 is continuous with the upper end of the first casing surface 23, and the second casing surface 24 forms a predetermined angle with respect to the first casing surface 23. That is, the first casing surface 23 and the second casing surface 24 have a curved shape and form a relatively gentle angle of 90 degrees or more and less than 180 degrees.

Figure 4:
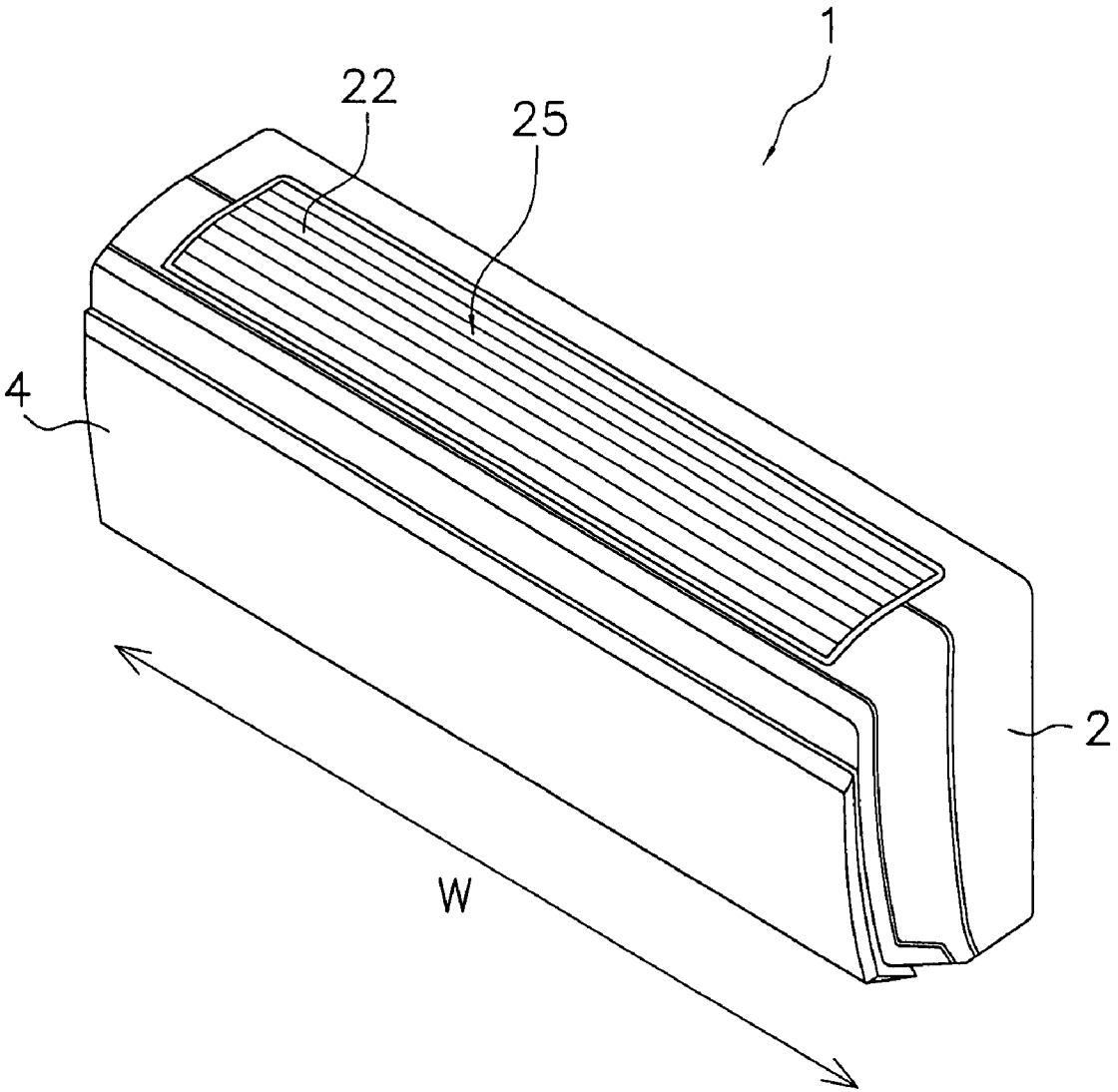
FIG. 4 is an external perspective view of the air conditioner in a closed state.

The second inlet 22 is an opening through which air is taken into the indoor unit casing 2, and as shown in FIG. 4, is disposed in a top surface 25 of the indoor unit casing 2. The second inlet 22 is configured by plural slits that extend in the width W direction of the indoor unit casing 2.

<Horizontal Flap>

Figure 5:
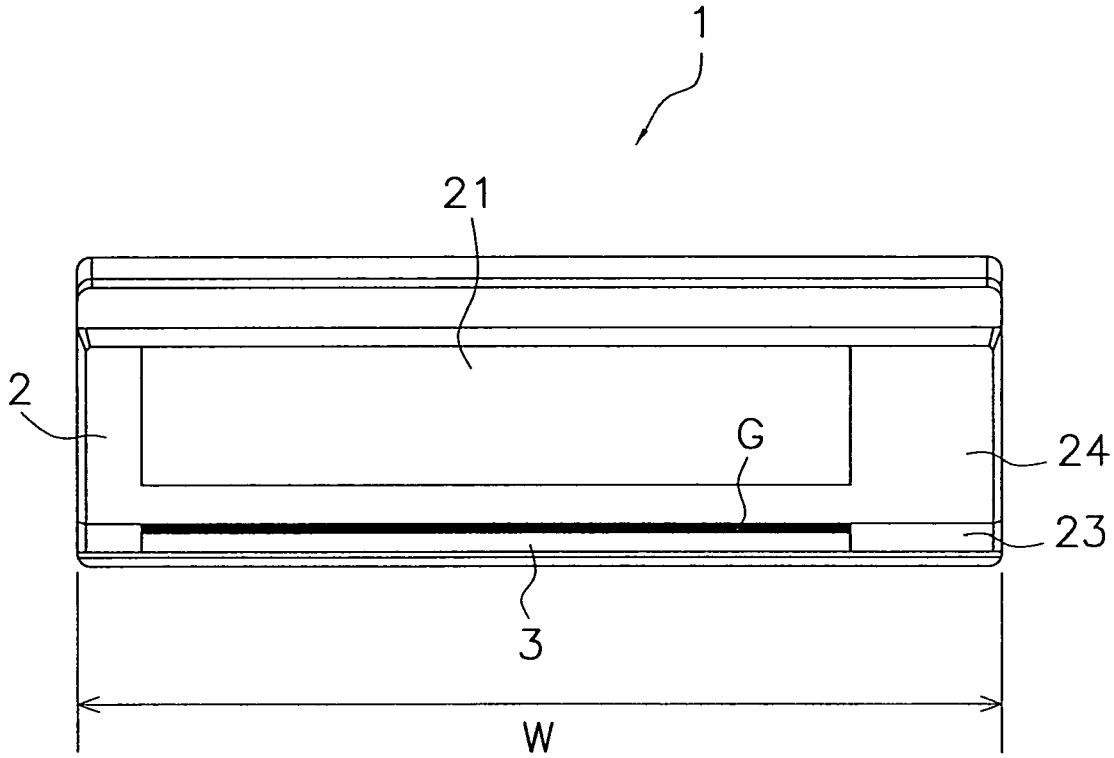
FIG. 5 is a front view of the indoor unit of the air conditioner from which a front panel has been removed.

The horizontal flap 3 is disposed so as to freely open and close the outlet 20 and guides the air blown out through the outlet 20. The horizontal flap 3 has a substantially rectangular shape that is long and narrow in the width W direction of the indoor unit casing 2, and is disposed over the outlet 20 so as to be rotatable about an axis parallel to the width W direction of the indoor unit casing 2. The horizontal flap 3 has a shape that is slightly smaller than the outlet 20, and as shown in FIG. 5, a gap G is disposed between the indoor unit casing 2 and the upper end of the horizontal flap 3 closing the outlet 20. Because this gap G is disposed, the horizontal flap 3 is rotatable with little restriction in the outlet 20. It will be noted that FIG. 5 is a front view of the indoor unit 1 in a state where the front panel 4 has been removed.

<Front Panel>

The front panel 4 opens and closes the first inlet 21, and in the closed state, covers at least part of the indoor unit casing 2 and at least one end of the horizontal flap 3 closing the outlet 20. Specifically, as shown in FIG. 2 and FIG. 3, the front panel 4 overlaps, from the outer side, the vicinity of the upper end forming a long side of the horizontal flap 3 and the portion between the first casing surface 23 and the second casing surface 24. Consequently, in the closed state, the front panel 4 covers the gap G between the upper end of the horizontal flap 3 and the outlet 20. The front panel 4 has a curved shape so as to follow the curvature of the first casing surface 23 and the second casing surface 24 of the indoor unit casing 2. The front panel 4 has a shape that is longer than the outlet 20 in the width W direction of the indoor unit casing 2 and has a width W that is substantially the same as the width W of the indoor unit casing 2. Further, as shown in FIG. 1, the front panel 4 does not have a seam extending in the vertical direction when seen in front view. The front panel 4 includes a first panel portion 41 and a second panel portion 42.

The first panel portion 41 is a portion that covers the upper end of the horizontal flap 3 in the closed state of the front panel 4. The first panel portion 41 configures the lower portion of the front panel 4.

The second panel portion 42 is a portion that covers the first inlet 21 in the closed state of the front panel 4. The second panel portion 42 configures the upper portion of the front panel 4.

The upper end of the first panel portion 41 and the lower end of the second panel portion 42 are continuous, and the first panel portion 41 and the second panel portion 42 are integrated at a predetermined angle so as to follow the first casing surface 23 and the second casing surface 24 in the closed state of the front panel 4.

Figure 7:
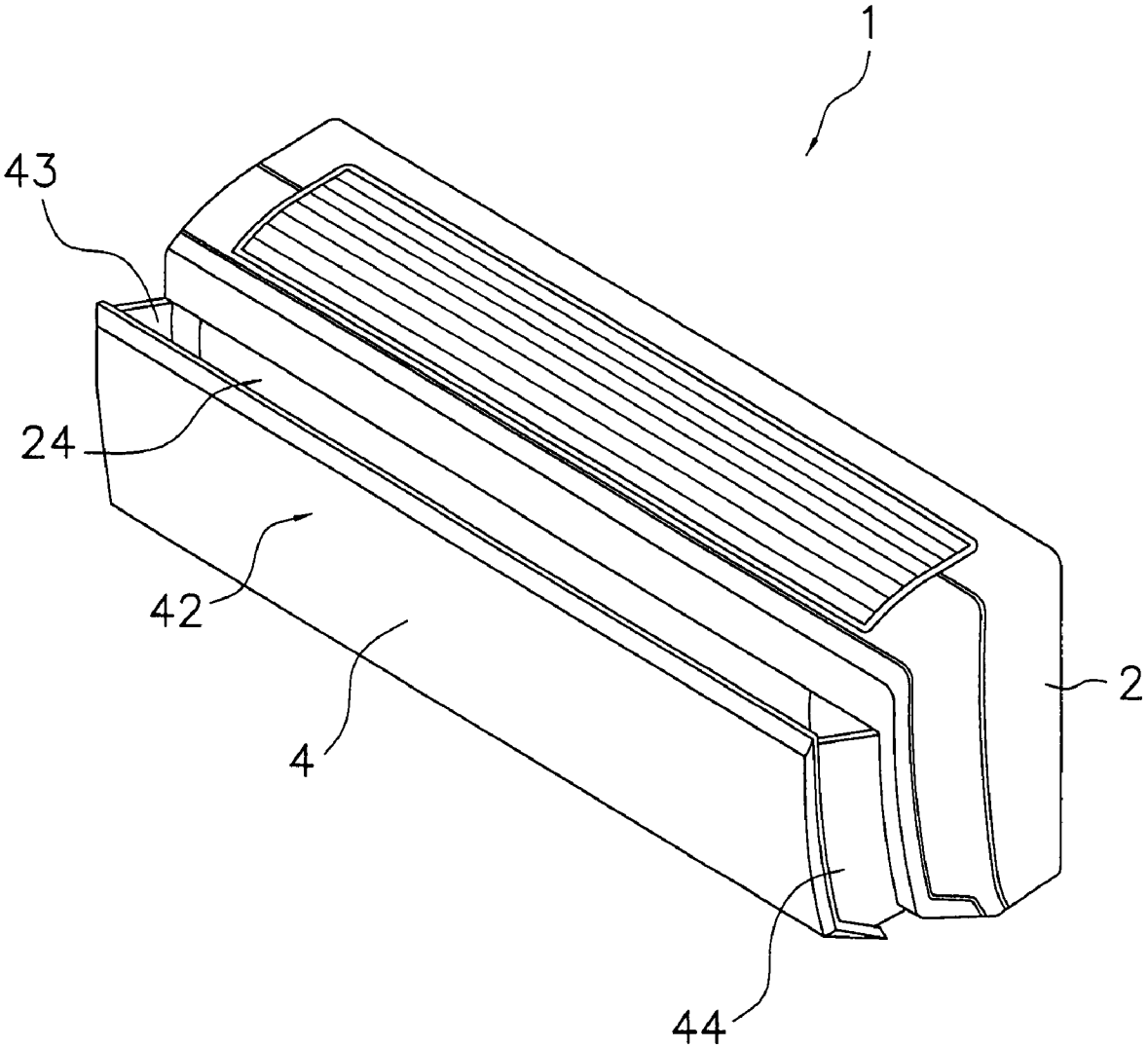
FIG. 7 is an external perspective view of the indoor unit of the air conditioner in an open state.

It will be noted that both side ends of the front panel 4 are supported by support plates 43 and 44 (see FIG. 7). The two support plates 43 and 44 are disposed on both side ends of the indoor unit casing 2, and are disposed so as to be movable back and forth. The front panel 4 moves when these supports 43 and 44 move.

<Opening and Closing Operation>

Figure 6C:
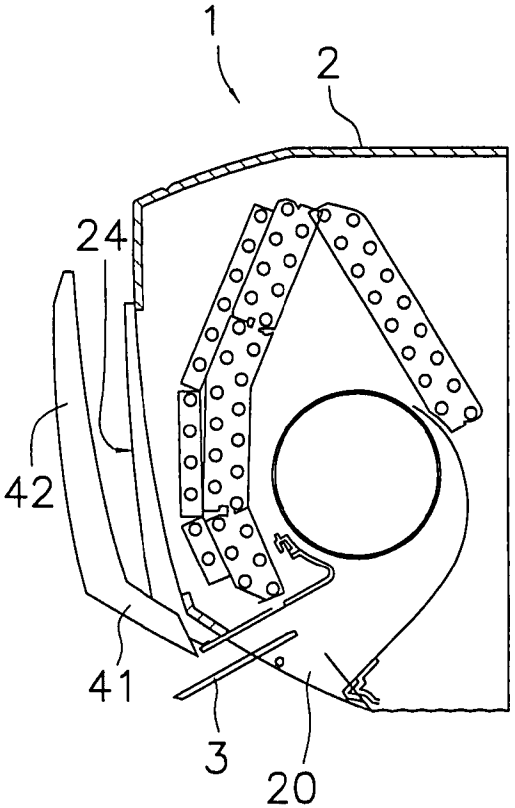
FIGS. 6 are diagrams showing an operation of opening and closing the front panel of the indoor unit of the air conditioner.
Figure 6B:
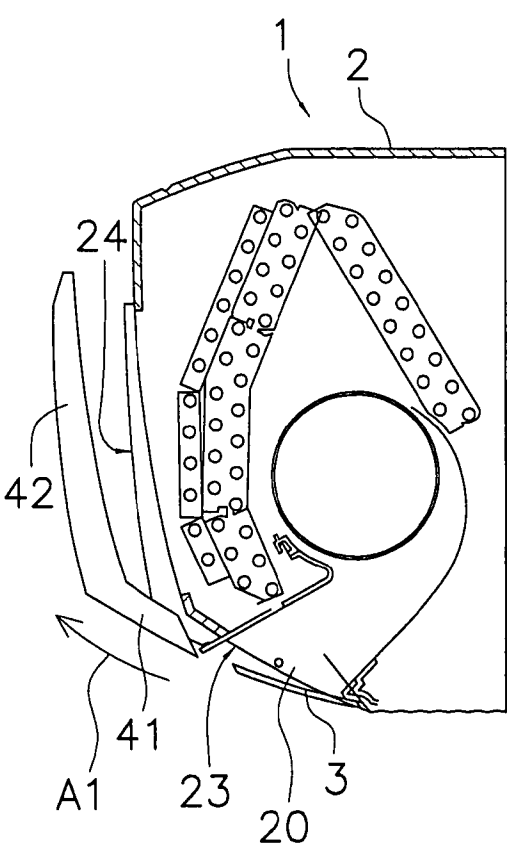
Figure 6A:
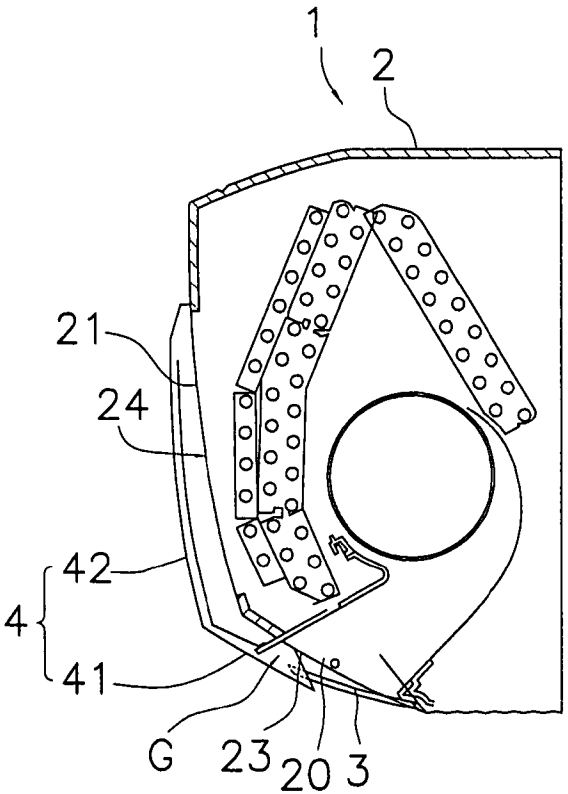

Next, the operation of opening and closing the front panel 4 will be described in detail on the basis of FIGS. 6.

When the indoor unit 1 of the air conditioner is shut down, the outlet 20 is by the horizontal flap 3 and the front panel 4 is closed. As shown in FIG. 6(*a*), in the closed state, the front panel 4 covers the first inlet 21 and covers the upper end of the horizontal flap 3. In this closed state, the first panel portion 41 covers the upper end of the horizontal flap 3, the gap G between the upper end of the horizontal flap 3 and the outlet 20, and the vicinity of the outlet 20 in the first casing surface 23. Further, the second panel portion 42 covers the second casing surface 24. The front panel 4 has a curved shape, and in the closed state, is close to the first casing surface 23 and the second casing surface 24 along the first casing surface 23 and the second casing surface 24. Thus, when the indoor unit 1 is shut down, the portion from the upper end of the horizontal flap 3 to the first inlet 21 is hidden from the outside.

Next, when the indoor unit 1 of the air conditioner begins running, the front panel 4 is opened. As shown in FIG. 6(*b*), the front panel 4 opens by moving diagonally upward and forward (refer to arrow A1). At this time, the front panel 4 opens the outlet 20 and the first inlet 21 as a result of the first panel portion 41 moving diagonally upward and forward along the first casing surface 23 and the second panel portion 42 moving diagonally upward and forward away from the second casing surface 24. At this time, it is ensured that the lower end of the first panel portion 41 moves to a position beyond the upper end of the outlet 20 so as to not obstruct the blowing-out from the outlet 20, and the first panel portion 41 blocks the lower portion between the second panel portion 42 and the second casing surface 24. Additionally, as shown in FIG. 6(*c*), the outlet 20 is opened when the horizontal flap 3 that had closed the outlet 20 rotates. Further, in this state, as shown in FIG. 7, the upper portion between the second panel portion 42 and the second casing surface 24 is opened so that the air taken in through the first inlet 21 can pass therethrough. It will be noted that, in the open state, both side portions between the second panel portion 42 and the second casing surface 24 are blocked by the support plates 43 and 44, and the support plates 43 and 44 become blindfold plates such that the inside of the indoor unit casing 2 cannot be see from the outside through the first inlet 21.

When the indoor unit 1 is shut down, the horizontal flap 3 rotates to close the outlet 20, and thereafter the front panel 4 moves oppositely from that described above such that the portion from the upper end of the horizontal flap 3 to the first inlet 21 is again hidden from the outside.

<Characteristics>

(1)

In this indoor unit 1 of an air conditioner, during shutdown, the portion from the upper end of the horizontal flap 3 to the first inlet 21 is hidden by the front panel 4. For this reason, it becomes difficult for the relatively large gap G for enabling the horizontal flap 3 to rotate to be seen from the outside. Thus, in this indoor unit 1 of an air conditioner, the aesthetic look is improved, such as the interiority improving.

Further, when the front panel 4 is not disposed, it becomes necessary to make the gap G small in order for the gap G to not be exposed to the front, but in this case, a restriction can be placed on the rotational direction of the horizontal flap 3. However, in this indoor unit 1 of an air conditioner, such restriction on the rotational direction of the horizontal flap 3 is alleviated.

(2)

In this indoor unit 1 of an air conditioner, as mentioned above, the relatively large gap G for enabling the horizontal flap 3 to rotate is covered by the front panel 4. For this reason, the degree of tight closure inside the indoor unit casing 2 when the indoor unit 1 shuts down is improved.

Further, when the indoor unit 1 is shut down, the ingress of dust and small creatures such as bugs into the indoor unit casing 2 through the gap G can be prevented.

(3)

In this indoor unit 1 of an air conditioner, hiding of the first inlet 21 and the upper end of the horizontal flap 3 is performed by the front panel 4 in which the first front panel 41 for hiding the gap G and the second panel portion 42 for covering the first inlet 21 are integrated. For this reason, the opening and closing of the outlet 20 and the first inlet 21 can be performed by an operation that is simple in comparison to when the first panel portion 41 and the second panel portion 42 operate separately.

(4)

In this indoor unit 1 of an air conditioner, the front panel 4 has a curved shape. For this reason, when the front panel 4 moves diagonally upward and forward, the first panel portion 41 blocks the lower end between the second panel portion 42 and the second casing surface 24. For this reason, in the open state, the occurrence of a short circuit, where the air blown out through the outlet 20 passes through the lower portion between the second panel portion 42 and the second casing surface 24 and is again taken in through the first inlet 21, can be prevented. Further, because a short circuit is prevented, the front panel 4 can be relatively largely moved, and the area of the opening disposed in the upper portion between the second panel portion 42 and the second casing surface 24 can be largely ensured.

<Another Embodiment>

In the preceding embodiment, the length of the lower end of the front panel 4 is short for a smooth opening and closing operation, and the vicinity of the lower end of the horizontal flap 3 is not covered by the front panel 4. However, from the standpoint of improving the aesthetic look, the front panel 4 may also cover the entire horizontal flap 3.

INDUSTRIAL APPLICABILITY

The present invention has the effect that its aesthetic look can be improved, and it is useful as an indoor unit of an air conditioner.

What is claimed is:

1. An indoor unit of an air conditioner comprising:

a casing including an outlet through which air is blown into a room;

a flap disposed so as to freely open and close the outlet and guide the air blown out through the outlet; and a front panel configured to cover at least part of the casing and at least one end of the flap closing the outlet in a closed state, the outlet being disposed in a lower portion of the casing, and the front panel overlapping at least an upper end of the flap in the closed state.

2. An indoor unit of an air conditioner comprising:

a casing including an outlet through which air is blown into a room;

a flap disposed so as to freely open and close the outlet and guide the air blown out through the outlet; and a front panel configured to cover at least part of the casing and at least one end of the flap closing the outlet in a closed state, in the closed state, the front panel covering at least one end of the flap and an inlet through which air is taken into the casing.

3. The indoor unit of claim 2, wherein the front panel includes a first panel portion that covers at least one end of the flap and a second panel portion that covers the inlet, and the first panel portion and the second panel portion are integrated.

4. The indoor unit of claim 3, wherein the casing further includes a first casing surface in which the outlet is disposed, and a second casing surface in which the inlet is disposed and which forms a predetermined angle with respect to the first casing surface, the first panel portion and the second panel portion being integrated at the predetermined angle so as to follow the first casing surface and the second casing surface in the closed state.

5. The indoor unit of claim 4, wherein the front panel opens the outlet and the inlet as a result of the first panel portion moving along the first casing surface and the second panel portion moving away from the second casing surface.

6. The indoor unit of claim 5, wherein the first panel portion blocks a space between the second panel portion and the second casing surface in an open state where the front panel opens the outlet and the inlet.

7. An indoor unit of an air conditioner comprising:

a casing including an outlet through which air is blown into a room;

a flap disposed so as to freely open and close the outlet and guide the air blown out through the outlet; and a front panel configured to cover at least part of the casing and at least one end of the flap closing the outlet in a closed state, the outlet having a shape that is long and narrow in a width direction of the casing, and the front panel having a shape that is longer than the outlet in the width direction.

8. The indoor unit of claim 7, wherein the front panel has a width that is substantially the same as a width of the casing.

9. An indoor unit of an air conditioner comprising:

a casing including an outlet through which air is blown into a room;

a flag disposed so as to freely open and close the outlet and guide the air blown out thorough the outlet; and a front panel configured to cover a gap between the casing and the flap closing the outlet in a closed state, the flap covering a lower portion of the outlet in the closed state, and the front panel covering an upper portion of the outlet in the closed state.

10. An indoor unit of an air conditioner comprising:

a casing including an outlet through which air is blown into a room;

a flag disposed so as to freely open and close the outlet and guide the air blown out through the outlet; and a front panel configured to cover a gap between the casing and the flap closing the outlet in a closed state, the front panel in the closed state covering one end of the flap when viewed in a front view.

* * * * *